US007992850B2

(12) United States Patent
Zhang et al.

(10) Patent No.: US 7,992,850 B2
(45) Date of Patent: Aug. 9, 2011

(54) SYSTEM AND METHOD FOR CONTROLLING ELECTROMAGNET LIFT POWER FOR MATERIAL HANDLERS

(75) Inventors: Xiaojun Zhang, Peoria, IL (US); Timothy Lynn Cooper, Metamora, IL (US); James Ivan Portscheller, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 1167 days.

(21) Appl. No.: 11/729,440

(22) Filed: Mar. 29, 2007

(65) Prior Publication Data

US 2008/0239612 A1 Oct. 2, 2008

(51) Int. Cl.
*B25B 1/00* (2006.01)

(52) U.S. Cl. ..... 269/3; 361/139; 361/143; 361/144; 269/58

(58) Field of Classification Search ..... 361/144, 361/139, 141, 187; 269/3, 58; 335/289–294; 187/277, 414; 414/737, 606; 294/65.5
See application file for complete search history.

(56) References Cited

U.S. PATENT DOCUMENTS

| | | | | | |
|---|---|---|---|---|---|
| 2,622,750 | A | * | 12/1952 | Ehlers | 414/619 |
| 3,120,631 | A | * | 2/1964 | Morgan | 335/291 |
| 4,200,832 | A | | 4/1980 | Johansson et al. | |
| 4,237,455 | A | * | 12/1980 | Beckley et al. | 340/685 |
| 4,323,329 | A | * | 4/1982 | Chlad | 414/737 |
| 4,378,547 | A | * | 3/1983 | Goedhart et al. | 335/291 |
| 4,378,548 | A | * | 3/1983 | Rybak | 335/291 |
| 5,206,776 | A | | 4/1993 | Bodenheimer et al. | |
| 5,325,260 | A | * | 6/1994 | Repetto | 361/144 |
| 5,390,068 | A | | 2/1995 | Schultz et al. | |
| 5,418,675 | A | | 5/1995 | Bodenheimer et al. | |
| 5,453,673 | A | | 9/1995 | Yang | |
| 5,497,332 | A | | 3/1996 | Allen et al. | |
| 5,528,445 | A | | 6/1996 | Cooke et al. | |
| 5,731,705 | A | * | 3/1998 | Guinn | 335/291 |
| 5,813,661 | A | * | 9/1998 | Vann | 254/418 |
| 5,813,712 | A | * | 9/1998 | Mozelt | 294/65.5 |
| 5,905,624 | A | * | 5/1999 | Andreica et al. | 361/144 |
| 5,953,196 | A | * | 9/1999 | Zimmermann | 361/144 |
| 5,959,416 | A | * | 9/1999 | Clutter et al. | 318/141 |
| 6,043,632 | A | * | 3/2000 | Maehara et al. | 322/28 |

(Continued)

FOREIGN PATENT DOCUMENTS

DE 2610781 9/1977

(Continued)

OTHER PUBLICATIONS

Partial English-Language Translation of German Patent No. 26 10 781, 6 pages.

*Primary Examiner* — George Nguyen
(74) *Attorney, Agent, or Firm* — Finnegan, Henderson, Farabow, Garrett & Dunner LLP

(57) ABSTRACT

A method for operating an electromagnetic lift that includes a generator-driven electromagnet comprises adjusting a position of the electromagnet, in response to a first position command. Upon receiving a lift command, an output power level of a generator is established at a predetermined level above a predefined normal power level. In response to an excess release command, the output power level is set to a first predetermined level below the normal power level. In response to a transport command, the output power level is established as approximately the normal power level. Upon receiving a release command, the output power level is established at a second predetermined level below the normal power level.

20 Claims, 4 Drawing Sheets

U.S. PATENT DOCUMENTS

| | | | | |
|---|---|---|---|---|
| 6,262,553 | B1 | 7/2001 | Menze | |
| 6,437,864 | B1 * | 8/2002 | Watanabe et al. | 356/399 |
| 6,701,221 | B1 | 3/2004 | Eaton et al. | |
| 6,798,627 | B2 | 9/2004 | Schultz et al. | |
| 7,117,952 | B2 * | 10/2006 | Bares et al. | 172/40 |
| 7,506,725 | B2 * | 3/2009 | Kuo et al. | 187/267 |
| 7,564,662 | B2 * | 7/2009 | Zhang et al. | 361/20 |
| 7,791,856 | B2 * | 9/2010 | Samila | 361/144 |
| 2001/0009363 | A1 | 7/2001 | Rice et al. | |
| 2005/0052533 | A1 * | 3/2005 | Ito et al. | 348/169 |
| 2005/0189179 | A1 * | 9/2005 | Bean | 187/277 |
| 2008/0191504 | A1 * | 8/2008 | Pollock et al. | 294/65.5 |
| 2009/0251252 | A1 * | 10/2009 | Wang et al. | 335/290 |

FOREIGN PATENT DOCUMENTS

| | | | |
|---|---|---|---|
| DE | 103 61 337 | | 7/2008 |
| EP | 0 854 408 | | 7/1998 |
| GB | 756759 | | 9/1956 |
| GB | 1184919 | | 3/1970 |
| JP | 02 295890 | | 12/1990 |
| JP | 2004173407 | A * | 6/2004 |
| JP | 2006 315814 | | 11/2006 |

* cited by examiner

SYSTEM AND METHOD FOR CONTROLLING ELECTROMAGNET LIFT POWER FOR MATERIAL HANDLERS

TECHNICAL FIELD

The present disclosure relates generally to control systems for material handlers and, more particularly, to systems and methods for controlling the lift power associated with electromagnetic lift attachments for material handlers.

BACKGROUND

Electromagnets have been used in variety of work environments, and are particularly useful in environments that require lifting, moving, or transporting large amounts of magnetic materials. For example, electromagnets may be used in shipping ports to move containers from ships in port to flatbed truck trailers for ground transportation. Alternatively, electromagnetic lifts may be employed in scrap yards to move, organize, and load scrap material for recycling or reprocessing.

Electromagnets are typically powered by a electrical power source, which produces a magnetizing current to the coils of the electromagnetic lift. The current induces a strong magnetic field on the face of the electromagnetic device, which can be used to lift and transport metallic or magnetic materials. The current that is input to the electromagnet may be turned on and off through the use of operator-controlled switches. By controlling the switches, an operator can energize the electromagnet to lift and hold an object and de-energize the electromagnet to drop the object.

One such electromagnetic lift system is described in U.S. Pat. No. 5,325,260 ("the '260 patent") to Repetto. The '260 patent describes a power source and control system for an electromagnetic lift. The electromagnetic lift is powered by a DC-rectified AC power source (e.g., an alternator) coupled to an electromagnet via relay devices. The relay switches can be manually operated to supply energizing current to the electromagnet to lift, transport, and drop objects using electromagnetic lift.

Although the system described in the '260 patent may provide an electromagnetic lift system for transporting objects within a work environment, it may still be inadequate and inefficient. Specifically, the system of the '260 patent only allows the operator to toggle the electromagnet between on and off states (i.e., "lift" and "drop"). Often, material that is initially lifted and held by the electromagnet may loosen during transport, due, for example, to vibration of the boom and/or interaction with other material held by the electromagnet. Consequently, objects that become dislodged may fall from the electromagnet before being transported to their intended destination, which may increase the time required to perform material transfer tasks associated with certain work environments, potentially limiting the overall productivity of the work environment. In addition to any costs associated with lost productivity, material that falls from the boom may be damaged and/or may damage the machine, potentially decreasing work site profitability. Accordingly, in order to minimize inefficiency and damage to a work environment resulting from objects that become dislodged and fall from an electromagnetic lift, a system for limiting the amount of loosely-held material transported by the electromagnet may be required.

The presently disclosed system and method for controlling electromagnetic lift power for material handlers are directed toward overcoming one or more of the problems set forth above.

SUMMARY OF THE INVENTION

In accordance with one aspect, the present disclosure is directed toward a method for operating an electromagnetic lift that includes a generator-driven electromagnet. The method comprises adjusting a position of an electromagnet, in response to a first position command. Upon receiving a lift command, an output power level of a generator may be established at a predetermined level above a predefined normal power level. In response to an excess release command, the output power level may be set to a first predetermined level below the normal power level. In response to a transport command, the output power level may be established as approximately the normal power level. The position of the electromagnet may be adjusted in response to a second position command. Upon receiving a release command, the output power level may be established at a second predetermined level below the normal power level.

According to another aspect, the present disclosure is directed toward a power management system for an electromagnetic lift, the system comprising an electromagnet, a generator electrically coupled to the electromagnet and configured to provide electrical output power for energizing the electromagnet, and a controller communicatively coupled to the generator. The controller may be configured to adjust a position of the electromagnet, in response to a first position command. Upon receiving a lift command, the controller may establish the electrical output power at a predetermined level above a predefined normal power level. In response to a excess release command, the controller may establish the electrical output power at a first predetermined level below the normal power level. In response to a transport command, the controller may establish the electrical output power substantially as the normal power level. The controller may also be configured to adjust the position of the electromagnet, in response to a second position command. Upon receiving a release command, the controller may establish the electrical output power at a second predetermined level below the normal power level.

In accordance with yet another aspect, the present disclosure is directed toward a machine comprising at least one traction device for maneuvering the machine, a boom coupled to a portion of the machine and configured to operate at least one implement for performing a task associated with the machine, and a power management system for an electromagnetic lift. The power management system may include an electromagnet coupled to the boom, a generator electrically coupled to the electromagnet and configured to provide an output current for energizing the electromagnet, a joystick for receiving an operator input, and a controller communicatively coupled to the joystick and the generator. The controller may be configured to receive the operator input from the joystick and adjust a position of the electromagnet, in response to a first position command. Upon receiving a lift command, the controller may establish the output current at a predetermined level above a predefined normal current associated with the electromagnet. In response to a excess release command, the controller may establish the output current at a first predetermined level below the normal current associated with the electromagnet. In response to a transport command, the controller may establish the output current as approximately the normal current. The controller may also be configured to adjust the position of the electromagnet, in response to a second position command. Upon receiving a release command, the controller may establish the output current at a second predetermined level below the normal current associated with the electromagnet.

DETAILED DESCRIPTION

Figure 1:
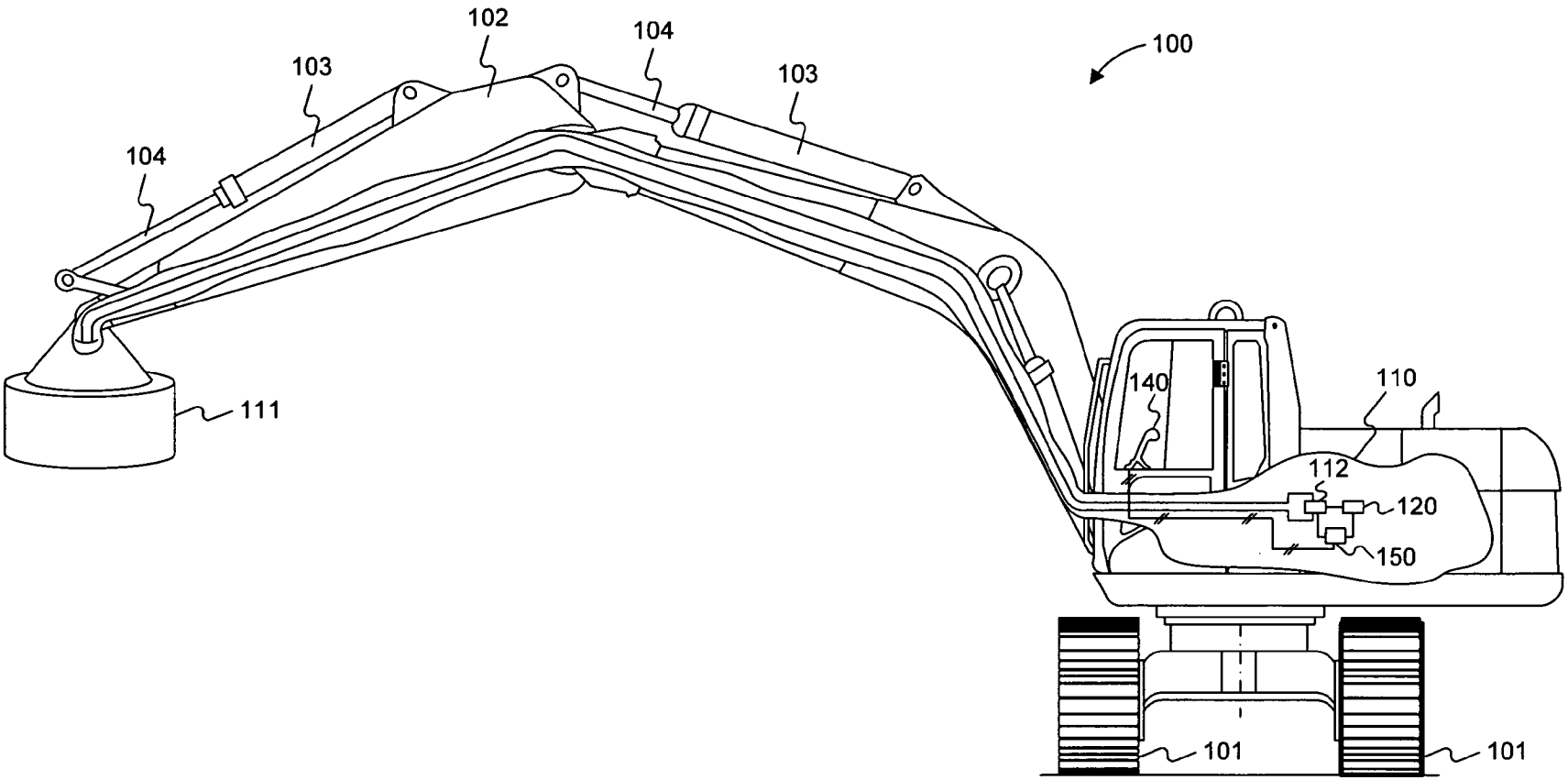
FIG. 1 illustrates a machine that includes an electromagnetic lift system, in accordance with certain disclosed embodiments.

FIG. 1 illustrates a machine 100 that includes a disclosed electromagnetic lift system 110. Machine 100 may be a fixed or mobile machine configured to perform an operation associated with a work environment. Thus, machine, as the term is used herein, refers to a fixed or mobile machine that performs some type of operation associated with a particular industry, such as mining, construction, farming, etc. and operates between or within work environments (e.g., construction site, mine site, power plants, etc.) Although machine 100 is illustrated as a material handler, it is contemplated that machine 100 may include any type of commercial or industrial device that includes a generator-driven electromagnet such as, for example, an electromagnetically driven transportation system (e.g., levitation train), an electromagnetic welding device, or any other type of electromagnetic device.

Machine 100 may include one or more components that cooperate to lift, move, transport, organize, and/or distribute metallic or magnetic material within an environment. Specifically, machine 100 may include one or more traction devices 101 for maneuvering machine 100, a hydraulically-controlled boom 102 for moving and positioning an implement (e.g., electromagnet 111), and an electromagnetic lift system 110 for lifting metallic and/or magnetic materials.

Traction devices 101 may include any surface engaging device adapted to move machine 100 within a work environment. For example, traction devices 101 may include a plurality of track-type ground engaging devices for propelling machine 100 across any type of solid or semi-solid terrain. Although traction devices 101 are illustrated as track-type devices, it is contemplated that traction devices may include any suitable type of surface-engaging device for maneuvering machine 100. For example, tractions devices 101 may include one or more of wheels, tires, amphibious movement devices, stabilizing supports, or any other suitable surface-engaging device for maneuvering machine 100 within an environment.

Boom 102 may include one or more components for holding, moving, positioning, or operating an implement, such as an electromagnet. For example, boom 102 may be part of a system that includes a hydraulic pump (not shown), one or more hydraulic pistons 104 at least a portion of which is fluidly sealed within a hydraulic cylinder 103, and a hydraulic valve (not shown). Alternatively and/or additionally, boom 102 may employ one or more electrical or mechanical components for operating an implement. For example, boom 102 may be driven by an electric motor that drives a shaft that operates a actuator for controlling or positioning boom 102. Boom 102 (and an associated implement) may be positioned, manipulated, or operated by controlling the operation of the hydraulic pump and valve to adjust the flow of fluid within one or more hydraulic cylinders, which extend and retract the hydraulic pistons in response to the fluid flow.

Figure 2:
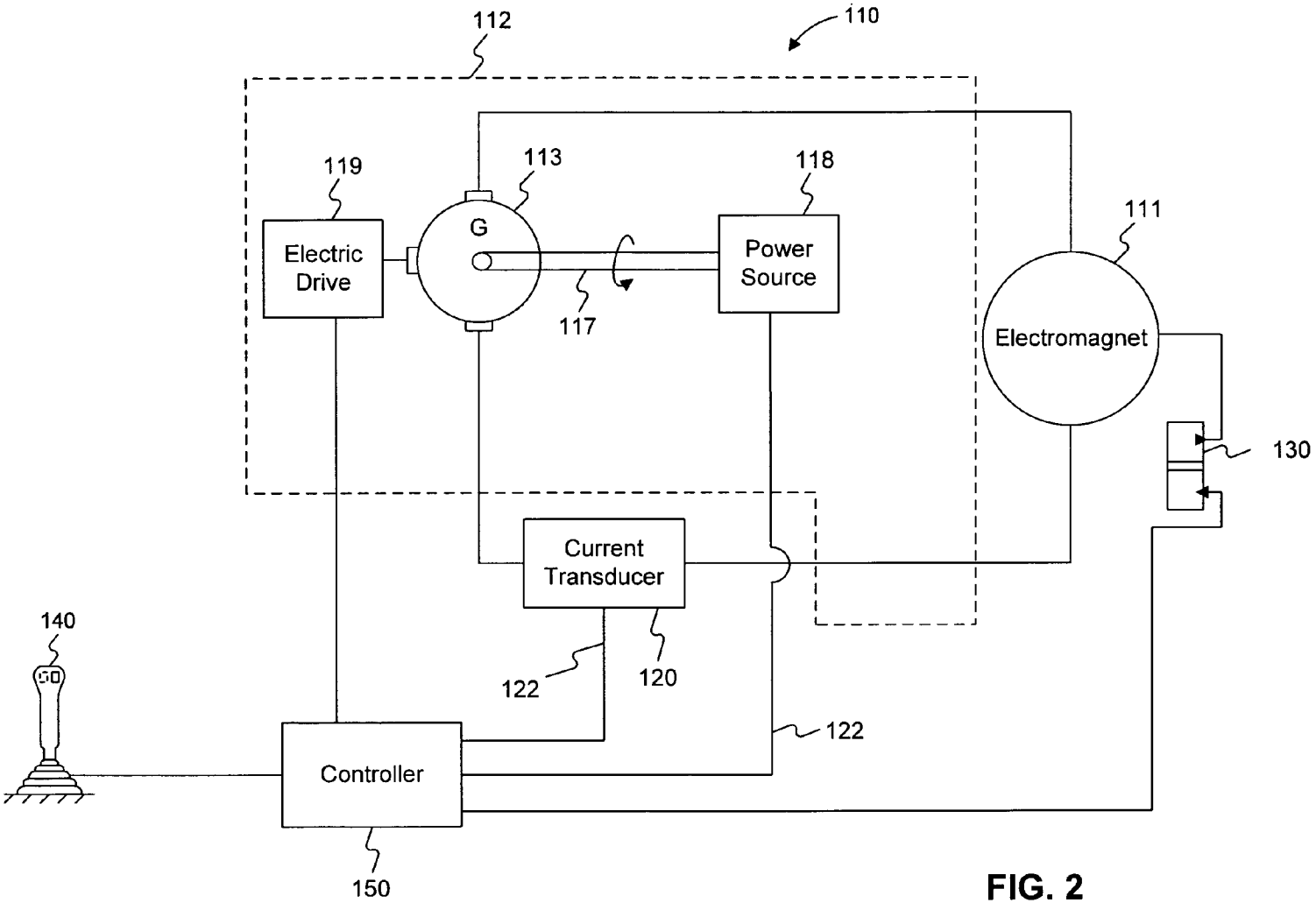
FIG. 2 provides a schematic illustration of an electromagnetic lift system, in accordance with the disclosed embodiments.

Electromagnetic lift system 110 may comprise an electromagnet 111, a generator set 112 for energizing electromagnet 111, a monitoring device for monitoring a power level associated with a circuit including generator set 112 and electromagnet 111, an input device 140 for receiving command data from an operator (not shown), and a controller 150 configured to receive command data from input device 140 and control one or more operational aspects of machine 100 based on the received power level and command data. It is contemplated that electromagnetic lift system 110 may include additional, fewer, and/or different components than those listed above. According to one embodiment, electromagnetic lift system 110 may include a monitoring device 120 (e.g., voltage sensor, current transducer, etc.) for monitoring the power level associated with electromagnet 111. Alternatively and/or additionally, as illustrated in FIG. 2, electromagnetic lift system 110 may include a release actuator 130 configured to agitate, shake, vibrate, or otherwise move electromagnet 111 for releasing loose material from electromagnet. FIG. 2 provides a detailed schematic illustration of an electromagnetic system 110 in accordance with certain disclosed embodiments.

Electromagnet 111 may include any type of device adapted to receive electrical energy and generate a magnetic field in response to the received electrical energy. Electromagnet 111 may include one or more conductor coils (not shown) wound substantially around a ferromagnetic core (not shown). As current is passed though the conductor coils of the electromagnet, a magnetic field is generated in the ferromagnetic core. The strength of the magnetic field may be proportional to the conductor coil current. Accordingly, the strength of the magnetic field may be adjusted by modifying the electrical current provided to the conductor coils of the electromagnet.

The shape and configuration of the electromagnet 111 may be determined based on the desired application of electromagnet 111. For magnetic lifts, for example, electromagnet 111 may be configured such that a majority of the magnetic field is concentrated substantially along a face of the electromagnet that will interface with a device to be lifted. It is contemplated, however, that other configurations and arrangements of electromagnet 111 may be implemented to affect the efficiency of electromagnetic lift system 110. Accordingly, the size, type, and arrangement of electromagnet 111 are exemplary only and not intended to be limiting.

Generator set 112 may include a plurality of components operable to provide power for energizing electromagnet 111. For example, generator set 112 may include a generator 113 and a power source 118 for providing a mechanical power output for generator 113. Generator set 112 may also include an electric drive 119 that controls the power output to electromagnet 111 by regulating the voltage level provided to energizing coils associated with generator 113. Generator set 112 may include additional, fewer, and/or different components than those listed above. For example, generator set 112 may include one or more sensors, actuators, and/or controllers for monitoring and controlling one or more operational aspects associated with one or more components of generator set 112. Accordingly, the components listed above are exemplary only and not intended to be limiting.

Generator 113 may include any type of device that may be configured to convert mechanical energy to electrical energy. For example, in response to a mechanical power output received from power source 118, generator 113 may convert at least a portion of the mechanical energy to electrical energy that may be used to energize the conductor coils of electromagnet 111. According to one embodiment, generator 113 may include a DC generator. Alternatively, generator 113 may include an AC generator, which may be coupled to a rectifier for converting at least a portion of the AC power output to a DC power output. Generator 113 may be configured to provide constant voltage output (e.g., 230V or any other suitable level) for energizing electromagnet 111.

According to one embodiment, generator 113 may include a separately-excited DC generator that includes one or more shunt coils (not shown) coupled to a separate power supply (not shown). The shunt power supply may include any type of suitable electrical power source such as, for example, a generator, a DC power source, a rectified AC power source, electric fuel cell, or any other suitable device for providing electric power output to energize a shunt field winding of a separately-excited DC generator. The separately-excited DC generator may provide machine operator with an additional current control mechanism (i.e., separate shunt and field winding power control), allowing the operator to control the generator output with greater precision than in shunt-, series-, or compound-wound DC generators.

Generator 113 may include various components that cooperate to produce an electric power output. For example, generator 113 may include a stator for producing a magnetizing current. By rotating an armature or rotor that includes a coil of wire within the magnetic field created by the magnetizing current in the stator, a current may be induced in the coil. The armature or rotor may be coupled to a shaft that may be rotated by a mechanical torque provided by mechanical power source 118. By controlling the speed of rotation and the amplitude of the magnetizing current, the current level induced in the coil of wire may be adjusted. This current level may be used to provide electrical energy, such as that required to energize electromagnet 111.

Power source 118 may include any device configured to provide mechanical a power output for rotating a shaft 117 coupled to a rotor of generator 113. In one example, power source 118 may include a hydraulic pump/motor that pressurizes a fluid to rotate a shaft coupled to the rotor of generator 113. In another example, power source 118 may be a combustion engine system associated with machine 110, wherein a portion of the mechanical output generated by the engine is harnessed to rotate the rotor of generator 113. According to yet another example, power source 118 may include an electric motor coupled to a battery, fuel cell, or another suitable electric power source. The electric motor may be configured to rotate the shaft associated with the rotor of generator 113. It is contemplated that multiple power sources may each be selectively coupled to and configured to drive generator 113 to maintain the overall efficiency of machine 100. For example, a combustion engine may be selectively coupled to generator 113 and configured to drive generator 113 during normal engine operating conditions. However, during periods of peak loading of the engine, causing the engine to operate below a desired efficiency, an electric motor may be coupled to generator 113 to provide additional mechanical output power required to drive generator 113.

Electric drive 119 may include one or more components or systems adapted to control the electric power output from generator 113. For example, electric drive 119 may include an electric power supply (not shown) coupled to field windings of generator 113. The electric power supply may include a battery, fuel cell, or any other device suitable for providing energizing power to field windings of generator 113. Electric drive 119 may also include a voltage regulator for adjusting the voltage level provided to generator 113 by the electric power supply. By regulating the voltage, electric drive 119 may control the strength of the magnetic field, thereby controlling the power induced in the armature windings of generator 113. The voltage regulator may embody a plurality of switches for selectively coupling the electric power supply to the field windings of the generator. By controlling the timing and sequence of the operation of the switches, electric drive 119 may adjust the magnetic field excitation and, correspondingly, the output current induced in the armature windings.

Alternatively and/or additionally, electric drive 119 may include one or more devices for regulating the speed of the rotor, thereby controlling the power output of generator 113. For instance, electric drive 119 may include one or more devices for regulating the speed of rotation of shaft 117 and/or rotation of power source 118. For example, electric drive 119 may include a device for adjusting a gear ratio torque converter or transmission that couples shaft 117 to power source 118.

Monitoring device 120 may include any type of device operable to detect a power level associated with electromagnetic lift system 110 and provide an output indicative of the detected power level to controller 150. For example, monitoring device 120 may include a current monitoring device such as, for example, a current transducer or Hall effect device, an ammeter, magneto-resistive current sensor, or any other suitable current monitoring device. Monitoring device 120 may measure a power level of the system and provide an output signal corresponding to the detected power level. Alternatively and/or additionally, monitoring device may include any suitable device for measuring power-related features of electromagnetic lift system 110 such as, for example, devices for measuring impedance, voltage, resistance, temperature, or any other parameter that may be associated with a power level of the system and/or may be used to determine the power level of electromagnet 111. According to one embodiment, monitoring device 120 may include a temperature sensor for monitor a temperature associated with electromagnet and provide an output indicative of the temperature of electromagnet 111 to controller 150.

Actuator 130 may be mechanically coupled to a portion of electromagnet 111 and may be configured to provide a mechanical output in response to a command signal. For example, actuator 130 may include a mechanical device coupled to a side portion of electromagnet 111 that, in response to a command signal received from controller 150, may shake, vibrate, agitate, rotate, or otherwise move electromagnet 111. By causing movement of electromagnet 111, actuator 130 may cause material that is loosely held by electromagnetic field to detach or de-couple from the electromagnet, potentially limiting the amount of material that may become dislodged and fall in transit. It is contemplated that actuator 103 may include a separate (e.g., optional) attachment to one or more of boom 102 or electromagnet 130.

According to one embodiment, actuator 130 may embody the boom of machine 100 or one or more components associated therewith. The boom may be operated to move or shake electromagnet 111 to detach or de-couple loosely held material from the electromagnet. For example, controller 150 may provide a command signal to a hydraulic valve associated with the boom of machine 100, in response to a command provided by a machine operator. Alternatively and/or additionally, shaking of the boom may be programmed into an electronic control module (EMC) of machine 100 and may be performed in response to a command signal provided by a machine operator. The command signal may open and close that hydraulic valve, increasing or decreasing the flow of pressurized fluid within a chamber of a piston, causing movement in the boom in response to the valve adjustment. By alternately increasing and decreasing the flow and/or volume of fluid into the piston chamber, the valve may cause sharp or oscillatory movements of the boom sufficient to dislodge loosely held material from electromagnet 111.

Input device 140 may include any type of device configured to receive, process, and/or transmit data between an operator of machine 100 and controller 150. For example, input device 140 may include a joystick controller installed in a cabin of machine 100. According to one embodiment, the joystick controller may be moved directionally. In response to the directional movements, controller 150 may operate traction devices 101 and/or boom 102 to maneuver machine 100 and/or an implement. Alternatively and/or additionally, the joystick controller may include one or more buttons that, when pressed, may be configured to adjust the strength of the magnetic field induced within electromagnet 111. Although input device 140 is illustrated as a single joystick controller, it is contemplated that additional and/or different types of input devices may be used. For example, input device may include a touchscreen-type controller, one or more lever-type controllers for controlling the hydraulic systems, and/or additional joystick-type controllers for controlling separate devices or subsystems associated with machine 100. According to one embodiment, Controller 150 may include a device for collecting, processing, analyzing, recording, and transmitting data associated with electromagnetic lift system 110 or components and subsystems associated therewith. Controller 150 may also be configured to control one or more operational aspects associated with components and subsystems of machine 110. According to one embodiment, controller 150 may include an electronic control module (ECM) associated with machine 100. Alternatively and/or additionally, controller 150 may include a control system dedicated exclusively to electromagnetic lift system 110. Controller 150 may be configured to collect data indicative of the power level associated with electromagnetic lift system 110 and control one or more aspects associated with machine 100, in response to the collected data.

Controller 150 may include one or more components for collecting, processing, and storing data associated with electromagnetic lift system 110. Controller 150 may include, among other things, a processor (not shown), volatile and/or non-volatile memory (e.g., RAM, ROM) (not shown), one or more storage devices (not shown), and one or more communication devices for communicating data with components and subsystems associated with electromagnetic lift system 110. It is contemplated that controller 150 may include additional, fewer, and/or different components than those listed above. Thus, the components listed above are exemplary and not intended to be limiting.

Controller 150 may be communicatively coupled to one or more components associated with electromagnetic lift system 110. For example, controller 150 may be coupled to one or more of power source 118, electric drive 119, monitoring device 120, actuator 130, and input device 140 via communication lines 122. Controller 150 may be configured to communicate with one or more components of electromagnetic lift system 110 over communication lines 122. It is contemplated that controller 150 may be communicatively coupled to additional, fewer, and/or different components than those listed above.

Controller 150 may be configured to receive operation data from one or more components associated with electromagnetic lift system 110. Operation data, as the term is used herein, refers to any information related to the performance of machine 100 and/or electromagnetic system 110. For example, operation data may include data collected by one or more sensors (such as monitoring device 120); commands received from input device 140; data related to the operation of generator, 113, power source 118, electric drive 119, or actuator 130; or any other data associated with machine 100 or any of its constituent components. According to one embodiment, controller 150 may receive operation data in the form of current data indicative of the current associated with electromagnet 111 from monitoring device 120. According to one embodiment, controller 150 may receive temperature data associated with electromagnet 111 and adjust a normal operating current associated with electromagnet 111 based on the temperature data. For example, if the temperature associated with electromagnet 111 exceeds a predetermined temperature limit, controller 150 may decrease the normal operating current to prevent electromagnet from overheating.

Controller 150 may be configured to receive operator command signals from input device 140. Operator command signals may include position commands and/or electromagnet operation commands received by an operator via input device 140. Position commands may include, for example, commands for maneuvering machine 100 within an environment, adjusting the position of hydraulically-controlled boom 102, or operating/positioning an implement. Electromagnet operation commands may include, for example, commands for controlling the magnetization of electromagnet 111 for lifting and releasing objects. According to one embodiment, electromagnet operation commands may include "lift" commands for increasing power output of generator 113 above a normal power output level; "excess release" commands for decreasing power output of generator 113 below a normal power output level; "transport" commands for restoring the power output of generator 113 to a normal power output level; and "release" commands for decreasing the power output of generator 113 to a level suitable to release objects from a magnetic field of electromagnet 111. It is contemplated that additional, fewer, and/or different operator commands than those listed above may be received by controller 150. The commands listed above are exemplary only and not intended to be limiting. For example, controller 150 may also receive an operator command signal configured to operate actuator 130 and/or hydraulic boom 102 to shake, agitate, or vibrate electromagnet 111 to free any loose material from electromagnet 111.

Controller 150 may also be configured to adjust the electrical power output of generator 113 for adjusting the strength of the magnetic field produced by electromagnet 111. For example, controller 150 may adjust a switch speed of a voltage regulator associated with electric drive 119, which adjusts the voltage applied to the field windings. The change in voltage of the field windings may induce a change in output current of generator 113, thereby modifying the strength of the magnetic field induced by electromagnet 111. Accordingly, by adjusting certain operational aspects associated with electric drive 119, controller 150 may adjust the strength of the magnetic field and, accordingly, the lift capacity associated with electromagnet 111.

Figure 3:
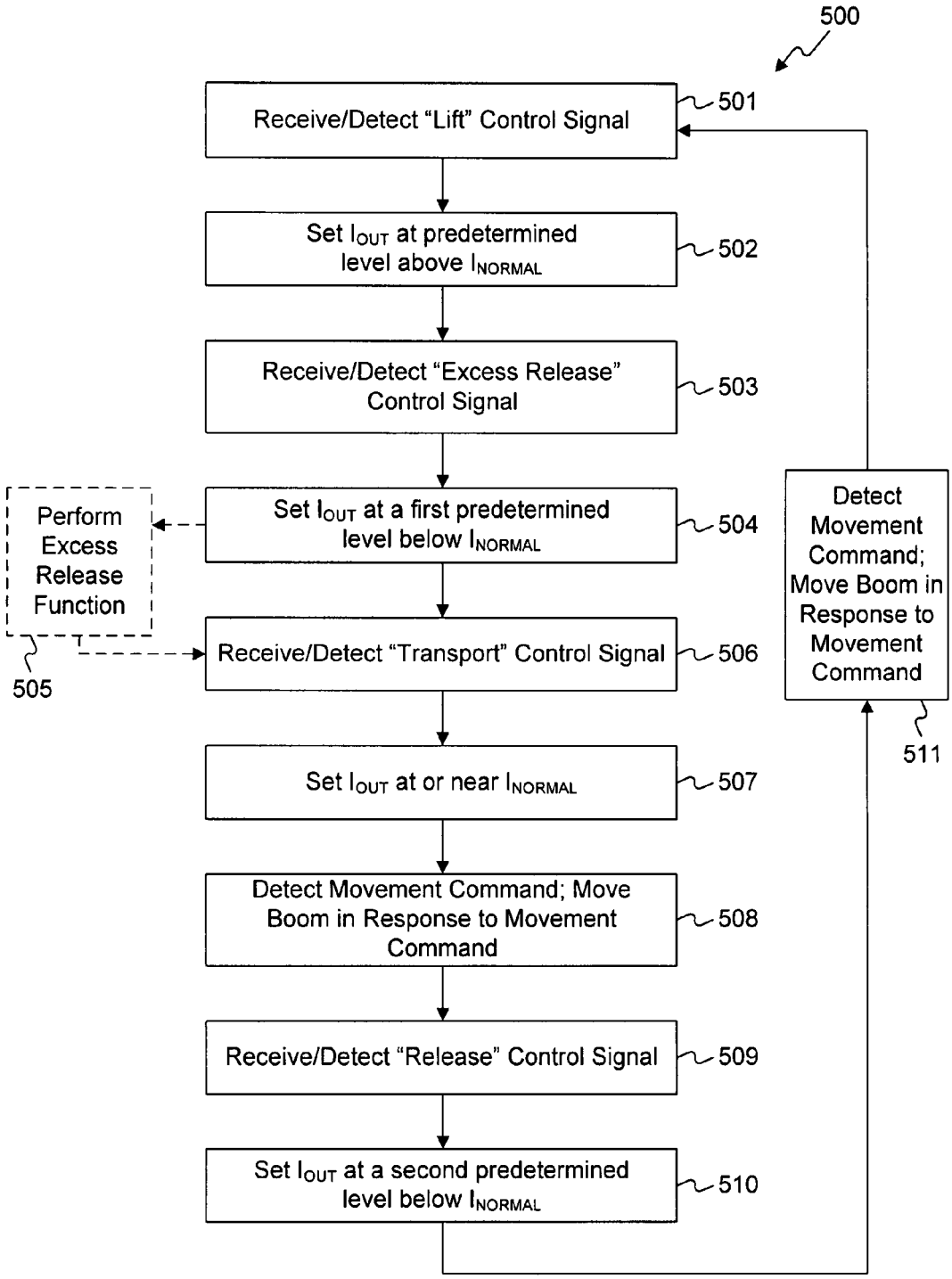
FIG. 3 provides a flowchart depicting a method for operating the electromagnetic lift system of FIG. 2.

Processes and methods consistent with the disclosed embodiments provide control features that enable equipment systems that employ electromagnetic lifts to systematically and predictably adjust the strength of the magnetic field generated by the lift, potentially limiting the amount of loose material that is held by the electromagnet after an initial lift process. FIG. 3 provides a flowchart 500 depicting a control method for operating an electromagnetic lift. As illustrated in FIG. 3, once electromagnet 111 is in a desired position (e.g., above an object or material to be transported), controller 150 may receive/detect a "lift" command signal from input device 140 (Step 501). For example, a machine operator may press a button or combination of buttons of the joystick, corresponding to a predetermined lift command. Controller 150 may receive/detect the lift command from the joystick and adjust an operational aspect of the controller so as to establish the generator output current, $I_{OUT}$, within a predetermined range above the normal generator output current, $I_{NORMAL}$ (Step 502). For example, according to one embodiment, $I_{OUT}$ may be set between 115%-130% of $I_{NORMAL}$. The normal generator output current includes a normal current (also referred to as normal maximum current) corresponding to the power level normally required to operate electromagnet 111. As explained, this power level may be associated with a predetermined temperature limit associated with electromagnet 111. For example, if generator 113 is configured to provide 230 VDC to a 15 kW electromagnet, the normal operating current can be determined (e.g., using the formula P=I·V) as approximately 65 Amps. Thus, upon receiving a lift signal from the joystick, controller 150 may adjust an operational aspect of generator 113 (and/or electric drive 119) to produce an output current substantially between 75 and 85 Amps. As a result, electromagnet 111 may generate a stronger magnetic field than that induced by $I_{NORMAL}$, thereby increasing the initial lift capacity of electromagnet 111 and ensuring that electromagnet 111 picks up an appropriate amount of material.

Once the generator current has been adjusted to provide a desired spike in the field strength of electromagnet 111, controller 150 may receive/detect an "excess release" control signal from input device 140 (Step 503). For example, if input device 140 is a one-button controller, the machine operator may simply press the button a second time to provide the "excess release" command signal. In the case of a multi-button controller, the machine operator may press the appropriate combination of buttons associated with a predetermined "excess release" command. In response to the "excess release" command, controller 150 may set $I_{OUTPUT}$ within a predetermined range below the normal generator output current, $I_{NORMAL}$ (Step 504). For example, according to one embodiment, $I_{OUT}$ may be set between 70-85% of $I_{NORMAL}$. Following the example above, generator 113 is configured to provide a normal operating current of approximately 45 and 55 Amps. As a result, electromagnet 111 may generate a weaker magnetic field than that induced by $I_{NORMAL}$, thereby decreasing the lift capacity of electromagnet 111 and allowing material that may be loosely held by electromagnet 111 to fall.

The normal operating current, as the term is used herein, may include a current level at which the temperature of coils associated with electromagnet 111 are within a normal operating range, so as to limit overheating associated with electromagnet 111. For example, if an energizing coil associated with electromagnet is rated for operation at or below a predetermined temperature, the normal current of electromagnet 111 may be established such that, under normal operating conditions, the current of electromagnet 111 may be limited to the normal operating current. It is contemplated, however, that in certain situations the current may be temporarily According to one embodiment, in addition to setting $I_{OUTPUT}$ between 70-85% of $I_{NORMAL}$, controller 150 may cause one or more components to perform an excess release function (Step 505). For example, controller 150 may provide a command signal that operates actuator 130 coupled to one or more of boom 102 and/or electromagnet 111. As explained, actuator 130 may shake, vibrate, agitate, rotate, or otherwise move electromagnet 111 to further loosen any material that is not tightly held within the magnetic field of electromagnet. Alternatively and/or additionally, controller 150 may be configured to cause hydraulic boom to shake by pulsing the hydraulic system to move the boom back and forth, thus shaking electromagnet 111. Operating actuator 130 or shaking electromagnet 111 while the magnetic field is weaker than under normal operating conditions may facilitate an increase in the amount of loose material that falls from electromagnetic 111 in its present location, thereby decreasing the amount of material that may fall during subsequent transport to a desired location.

Controller 150 may receive/detect a transport command signal from input device 140 (Step 506). For example, if input device 140 is a one-button joystick, a machine operator may provide the transport command by pressing the button of the joystick a third time. Alternatively, if input device 140 is a multi-button joystick, a machine operator may provide the transport command by pressing a predetermined combination of buttons of the joystick. Alternatively and/or additionally, a transport command may be detected in the form of a position command when a machine operator attempts to move machine 100 or boom 102 by operating the joystick. In response to the transport command signal, controller 150 may adjust an operational aspect of generator 113 (and/or electric drive 119) to produce and output current, $I_{OUTPUT}$, at or near 100% of $I_{NORMAL}$ (e.g., 65 Amps according to the example above) (Step 507).

Upon establishing resetting $I_{OUTPUT}$ back to the normal current level, controller 150 may receive/detect a position command from input device 140 (Step 508). For example, a machine operator may move the joystick corresponding to a desired movement of machine 100 or boom 102, in order to transport the material held by electromagnet 111 to a desired location. Controller 150 may receive the position command from the joystick and transmit a control signal to cause one or more of traction devices 101 or boom 102 to move in accordance with the received command signal.

Once the material has been transported to a desired destination, controller 150 may receive/detect a release control signal from input device 140 (Step 509). For example, if input device 140 is a one button controller, a machine operator may provide the release command by pressing the button of the joystick a fourth time. Alternatively, if input device 140 is a multi-button joystick, a machine operator may provide the release command by pressing the predetermined combination of buttons associated with the release command signal. In response to the command signal, controller may adjust an operational aspect of generator 113 (and/or electric drive 119) to establish the generator output current at a predetermined level below $I_{NORMAL}$ (Step 510). This predetermined level may be any level suitable to substantially reduce the strength of the magnetic field of electromagnet 111 in order to release substantially all of the material. For example, controller may establish the generator output current, $I_{OUTPUT}$, at or below 20% of $I_{NORMAL}$.

At any time during operation of the lift, controller 150 may receive/detect a position command signal from input device 140 (Step 511), and move machine 100 and/or hydraulic boom 102 in response to the position command. For example, a machine operator may move a joystick according to a desired movement of hydraulic boom 102, in order to position electromagnet 111, for example, above a scrap material pile.

The joystick may provide a signal indicative of the joystick movement to controller 150. In response to the position command, controller 150 may transmit an appropriate control signal to affect a corresponding movement in traction devices 101 and/or hydraulic boom 102.

Figure 4:
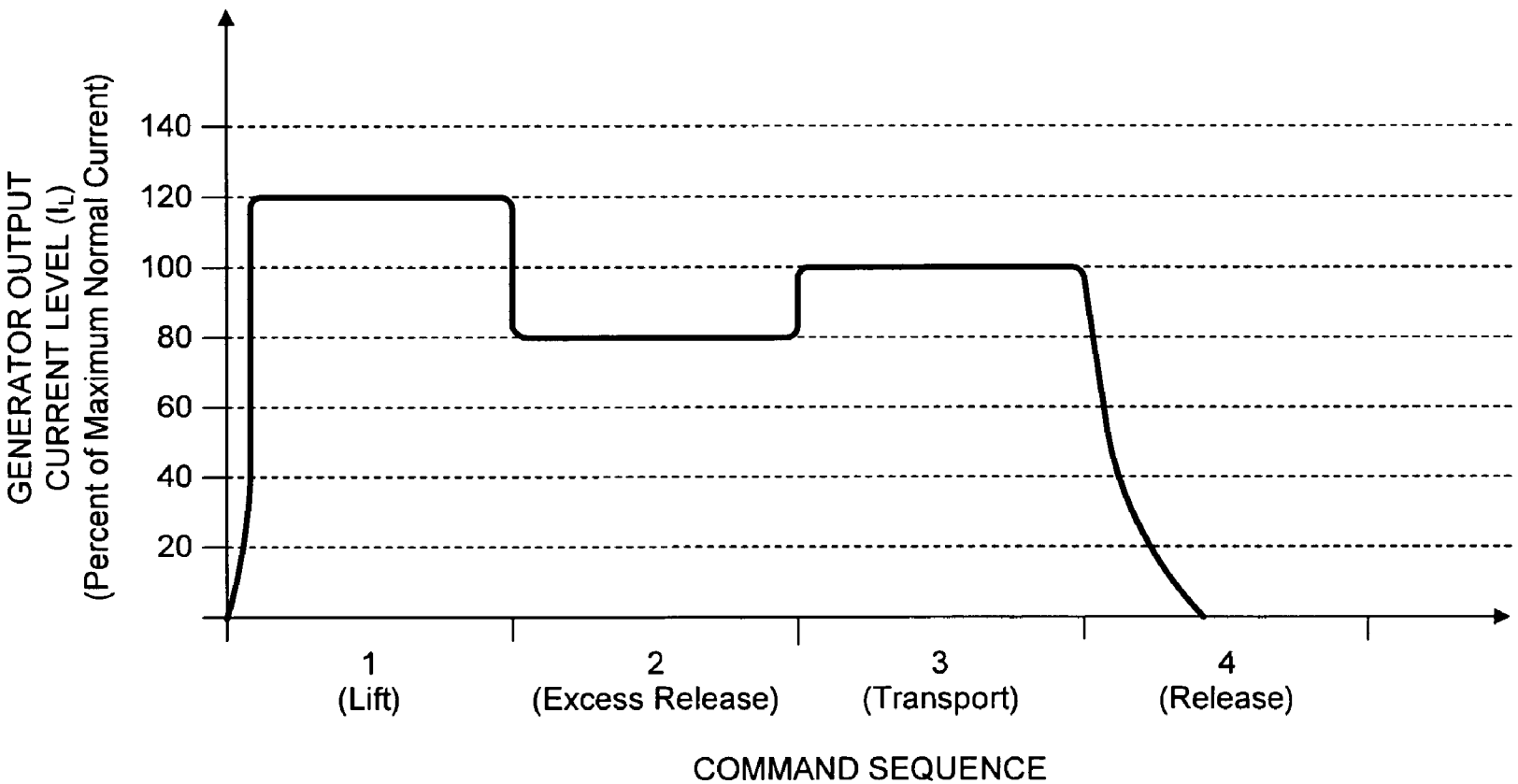
FIG. 4 provides a current flow diagram indicative of generator output current respective of particular operator commands, according to certain disclosed embodiments.

As explained, the processes and methods control electromagnetic lift power by controlling the current supplied to electromagnet 111, which, in turn, controls the strength of the magnetic field induced by electromagnet. Accordingly, by manipulating the generator output current, which supplies magnetizing current that energized electromagnet 111, a machine operator may be able to control the amount of material that is lifted and transported by the lift. By providing features, such as predetermined operator commands for adjusting the current output of generator 113 and systems for shaking and/or agitating electromagnet 111, the presently disclosed system may remove material that is loosely held by electromagnet 111 prior to transport of a load, thereby minimizing the amount of material that may become dislodged and fall in transit. FIG. 4 illustrates a generator output current profile, in accordance with the predetermined operator commands described above.

According to the embodiment shown in FIG. 4, upon receipt of the "lift" command, controller 150 may provide a command causing generator 113 to increase the current level supplied to electromagnet 111 until the current reaches the predetermined level above the maximum normal current, which in this example, is 120% of the maximum normal current (Phase 1 "Lift"). The increase in current above the "normal" current level may increase the amount of material that is initially picked up, thus increasing the likelihood that at least a portion of the material that is initially picked up is well established with electromagnet 111.

After the "lift" command sequence, controller 150 may provide an excess release command sequence, which affects a decrease in the generator output current to a first predetermined level below the maximum normal current (Phase 2 "Excess Release"). This may provide an interval for any loosely held material (i.e., material whose kinetic energy due to gravity is greater than the magnetizing force of electromagnet 111) to fall from electromagnet 111. In this example, the first predetermined level has been set to 80% of the maximum normal current. Those skilled in the art will recognize, however, that a different level may be set based on, for example, the type of material that is being transported. For example, if the environment requires that the amount of material lost in transit be extremely low, this level may be reduced to ensure that any material that loose material falls before transport of the load.

During this phase, an additional command may be provided to aid in this loosening process. For example, upon receipt of the excess release command, controller 150 may provide a command signal to actuator 130, which may be configured to vibrate or otherwise agitate electromagnet 111. According to one embodiment, actuator 130 may be configured to simulate the type of shaking movement that electromagnet may experience while transporting the load to a desired destination. Alternatively and/or in addition to actuator 130, controller 150 may cause boom 102 to shake back and forth, which may also loosen any material that is not held strongly by electromagnet 111.

After any loose material has fallen from electromagnet, controller 150 may provide a transport command sequence, which increases the generator output current to the normal current level (Phase 3 "Transport"). The transport phase will typically be maintained until the material has been moved to its desired destination. Once electromagnet 111 has been positioned in the desired destination, controller 150 may provide a release command sequence, which decreases the generator output current to a second predetermined level below the maximum normal current (Phase 4 "Release"). In this example, the second predetermined level below the normal current is set at or near 0. Those skilled in the art will recognize that this level may be set to any level that allows all material held by electromagnet to fall.

It is also contemplated that command signals associated with adjusting the generator current output (e.g., lift command, excess release command, release command, etc.) may be preprogrammed such that certain button sequences are associated with certain commands. It should be noted, however, that for single button joystick devices, the commands may be provided with successive presses of the joystick button. Specifically, a first button press may be associated with a "lift" command, a second button press may be associated with an "excess release" command, a third button press may be associated with a "transport" command, and a fourth button press may be associated with a "release" command. This cycle may be repeated during subsequent operations of the control sequence.

It is contemplated that the current levels shown in FIG. 4 are exemplary only and not intended to be limiting. As explained, the current levels may be adjusted and/or may correspond with predetermined current ranges. Furthermore, the normal operating current may be adjusted to prevent or limit overheating of electromagnet 111.

Although the methods described above are illustrated as being responsive to input commands received from the interaction of a machine operator with input device 140, it is contemplated that these methods may be programmed to be performed automatically. For example, an operator may initially program one or more pick-up locations and release locations. Accordingly, the positions commands, "lift" command, "excess release" command, "transport" command, and "release" command may be each programmed depending upon the desired generator output current produced during each stage and the time period required to carry out each command. Once programmed, the process may be automated so that controller 150 controls the position and operation of electromagnet 111 with no additional input being required from the machine operator.

INDUSTRIAL APPLICABILITY

Although the disclosed system and method for controlling electromagnet lift power are discussed in connection with electromagnetic lift systems for heavy machinery, they may be implemented in any system where it may be advantageous to control the magnetic field generated by an electromagnet. Specifically, the presently disclosed systems and methods may be used to efficiently and predictably manage the lift power of an electromagnetic lift by selectively controlling the energizing power level provided to the electromagnet by a power source.

The presently disclosed system for controlling electromagnetic lift power may have significant cost advantages over conventional lift systems. For example, the presently disclosed system may reduce or eliminate costs and equipment downtime associated with repairs to switches and switch controllers of conventional systems, thereby potentially increasing profitability and work site productivity.

In addition, the systems and methods described herein may increase work site efficiency in certain situations. For instance, by subsequently decreasing the lift capacity and agitating the electromagnet to dislodge any loose material before movement of the lift, the amount of material that is shaken loose and scattered during transit may be significantly reduced. Accordingly, the presently disclosed system and associated methods may limit the time and resources dedicated to gathering and transporting the material scattered during transit to its desired destination.

It will be apparent to those skilled in the art that various modifications and variations can be made to the presently disclosed system and method for controlling electromagnet lift power. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. A method for operating an electromagnetic lift that includes a generator-driven electromagnet, the method comprising:

establishing an output power level of a generator at a predetermined level above a predefined normal power level in response to a lift command;

establishing the output power level at a first predetermined level below the normal power level in response to an excess release command;

establishing the output power level at approximately the normal power level in response to a transport command; and establishing the output power level at a second predetermined level below the normal power level in response to a release command.

2. The method of claim 1, further including adjusting a position of an electromagnet in response to a position command signal.

3. The method of claim 1, further including providing a command signal to an actuator coupled to the electromagnet, wherein the actuator is configured to move the electromagnet in response to the command signal.

4. The method of claim 3, further including vibrating the electromagnet in response to the command signal to the actuator.

5. The method of claim 1, further including:

monitoring a temperature associated with a portion of the electromagnet; and adjusting the normal power level based on the monitored temperature.

6. The method of claim 5, wherein adjusting the normal power level includes:

comparing the monitored temperature with a predetermined temperature threshold; and reducing the normal power level if the monitored temperature exceeds the predetermined temperature threshold.

7. The method of claim 1, wherein one or more of the commands are preprogrammed to automatically occur at predetermined time intervals.

8. An electromagnetic lift system, comprising:

an electromagnet;

a generator electrically coupled to the electromagnet and configured to provide electrical output power for energizing the electromagnet; and a controller communicatively coupled to the generator and configured to:

establish an output power level of the generator at a predetermined level above a predefined normal power level in response to a lift command;

establish the output power level at a first predetermined level below the normal power level in response to an excess release command;

establish the output power level at approximately the normal power level in response to a transport command; and establish the output power level at a second predetermined level below the normal power level in response to a release command.

9. The system of claim 8, wherein the controller is further configured to provide a command signal to an actuator coupled to the electromagnet in response to the excess release command, wherein the actuator is configured to move the electromagnet.

10. The system of claim 9, further including a vibratory mechanism operatively coupled to the electromagnet.

11. The system of claim 9, wherein the controller is configured to cause the actuator to vibrate the electromagnet.

12. The system of claim 11, wherein the system includes a hydraulically-actuated boom that adjusts the position of the electromagnet, the excess release command signal configured to cause the hydraulically-actuated boom to shake the electromagnet.

13. The system of claim 8, further including an operator interface coupled to the controller, the operator interface including one or more buttons that, when pressed, provides a command signal corresponding to one or more of the lift command, the excess release command, the transport command, or the release command, the command signal being configured to establish the output current of the generator.

14. The system of claim 13, wherein the operator interface has one button and each operator command is provided sequentially when the button of the joystick is pressed.

15. The system of claim 8, further including an operator interface coupled to the controller, wherein the operator interface including first and second buttons and is configured to:

provide a lift command to the controller in response to a pressing of the first button;

provide an excess release command to the controller in response to a pressing of the first button followed by a first pressing of the second button before a release of the first button, provide a transport command in response to a release of the second button; and provide a release command in response to a second pressing of a second button.

16. The system of claim 8, wherein one or more of the commands are preprogrammed and where the controller is further configured to automatically perform the preprogrammed commands at predetermined time intervals.

17. The system of claim 8, further including a temperature sensor operatively coupled to the electromagnet and configured to provide an output indicative of a temperature of a portion of the electromagnet to the controller.

18. The method of claim 17, wherein the controller is further configured to:

monitor a temperature associated with a portion of the electromagnet; and adjust the normal power level based on the monitored temperature.

19. A machine comprising:

at least one traction device for maneuvering the machine;

a boom coupled to a portion of the machine and configured to cooperate with at least one implement for performing a task associated with the machine; and an electromagnetic lift system comprising:

an electromagnet coupled to the boom;

a generator electrically coupled to the electromagnet and configured to provide an output current for energizing the electromagnet;

an operator interface for receiving an operator input; and a controller communicatively coupled to the operator interface and the generator and configured to:

receive the operator input from the operator interface;

establish an output power level of the generator at a predetermined level above a predefined normal power level in response to a lift command;

establish the output power level at a first predetermined level below the normal power level in response to an excess release command;

establish the output power level at approximately the normal power level in response to a transport command; and establish the output power level at a second predetermined level below the normal power level in response to a release command.

20. The system of claim 19, wherein the controller is configured to cause an actuator to vibrate the electromagnet.

* * * * *